United States Patent [19]

Sterlini

[11] 4,261,177

[45] Apr. 14, 1981

[54] METHOD AND APPARATUS FOR EXCHANGING HEAT WITH A CONDENSABLE FLUID

[75] Inventor: Jacques Sterlini, Paris, France

[73] Assignee: Compagnie Electro-Mecanique, Paris, France

[21] Appl. No.: 13,531

[22] Filed: Feb. 21, 1979

[30] Foreign Application Priority Data

Feb. 20, 1978 [FR] France ..... 78 04798

[51] Int. Cl.[3] ..... F24F 3/16

[52] U.S. Cl. ..... 62/78; 62/116; 62/500

[58] Field of Search ..... 62/116, 500, 501, 78

[56] References Cited

U.S. PATENT DOCUMENTS 2,966,047 12/1960 De Paravicini ..... 62/116

4,023,946 5/1977 Schwartzman ..... 62/116

FOREIGN PATENT DOCUMENTS 305668 5/1955 Switzerland .

*Primary Examiner*—Ronald C. Capossela

*Attorney, Agent, or Firm*—Burns, Doane, Swecker & Mathis

[57] ABSTRACT

A process and apparatus for exchanging heat with condensable fluid are disclosed. In the process, a two-phase fluid is passed through the tubes of a heat exchanger under conditions of temperature and pressure such that the quality of the two-phase flow lies in the range of 0.03 to 0.97. The two-phase fluid is in a state of thermodynamic saturation at both the entry and exit of the heat exchanger. The change in quality of the two-phase mixture passing through the heat exchanger is distributed over the entire heat exchanger. The apparatus according to the invention includes a plurality of connected modular stages, each stage including a heat exchanger, a vapor-liquid separator, a compressor, an ejector and the suitable conduits to establish fluid communication between adjacent stages.

10 Claims, 4 Drawing Figures

METHOD AND APPARATUS FOR EXCHANGING HEAT WITH A CONDENSABLE FLUID

BACKGROUND OF THE INVENTION

The present invention relates to a process and apparatus for exhanging heat between fluids. One fluid, called the working fluid, is maintained at conditions of pressure and temperature where thermal heat exchanges lead to the evaporation or condensation of a portion of the working fluid mass. More specifically, the present invention concerns heat pump apparatus.

Heat pumps have been known for a long time, but the energy output and cost have not yet reached an acceptable level.

One reason for this lack of general acceptance is that there is no ideal working fluid which is well suited for the operating conditions under which heat pumps are most likely needed: e.g., a fluid in which the working temperatures are on the same order as environmental temperatures. Freon, water and ammonia are examples of commonly used working fluids. Freons work well due to their temperature of condensation at moderate pressure; however, the Freons are expensive, cannot be used in contact with grease or similar lubricants and cannot be released or diffused into the atmosphere. Using water at ordinary temperatures, heat pump installations must have an unacceptably large volume as a result of the corresponding operating low pressures. Ammonia has suitable working pressures in the area of a particular interest, has good heat exchange characteristics, and is far less expensive than the Freons, but ammonia is both corrosive and toxic.

Existing heat pump apparatus is also of importance in evaluating the state of the prior art. More particularly, the presently available heat pumps have mediocre heat exchange coefficients which necessitate comparatively voluminous heat exchangers. A natural consequence of large heat exchangers is the need for large masses of working fluid. This need for a large mass of working fluid is a substantial restriction since the working fluids are either costly, as in the case of Freon, or are dangerous, as in the case of ammonia.

One way of improving existing heat pumps is to improve their thermodynamic efficiency so as to obtain better transfer for a given quantity of working fluid.

An example of this approach is illustrated in a Patent No. CH 305,668 in which evaporation of the working fluid is done in stages, successive stages having decreasing or lower pressures and temperatures. The working fluid is extracted in its vapor stage at each stage and forwarded to a corresponding compressor where it reaches the vapor generated by a lower pressure stage that has already been compressed in another compressor stage. This concept has not achieved widespread acceptance. One may speculate that the reason is that either Freon or water is needed as a working fluid. In addition, the improvement in thermodynamic efficiency was limited since the vapor which eventually exhausts from the compressor is not at saturated thermodynamic conditions.

Another patent, French Pat. No. 7614965, published under No. 2,352,247, presents a more refined solution to the problem of improving the thermodynamic efficiency. In this patent, there are a plurality of modular stages in each of which evaporation of the working fluid takes place in stages. A compressed vapor coming from an adjoining modular stage at lower pressure is placed in contact with the liquid phase at a stage of the compressor so as to bring the vapor back to its saturated thermodynamic conditions. This process describes a zig-zag path on an entropy diagram which path represents the successive states of the vapor phase and always remains in proximity to the saturated vapor curve. With such a process, a variable energy is obtained which depends on the nature of the working fluid and its operating conditions. The process, however, is particularly interesting in the case of ammonia. The advantage of this process is considerably inhanced by the fact that the condensation of the working fluid in the high temperature area of a heat pump is also taking place in modular stages similar to those modular stages where the evaporation is occurring. In that patent, the heat exchangers themselves are not object of a specific concern. The heat exchangers are partially filled by the liquid phase of the working fluid. Tubes carrying the second heat exchanging fluid traverse the working fluid reservoir and attain heat exchange relationship with the working fluid while in the liquid phase or in the superheated vapor phase.

An arrangement such as that in the French patent requires the use of a large mass of working fluid which, as mentioned above, is undesirable especially in the case of ammonia. Moreover, there is no guarantee that the heat exchange coefficients would be favorable.

Accordingly, it is apparent that the need continues to exist for a heat exchanging process and apparatus which overcomes the defects of the types discussed above.

SUMMARY AND OBJECTS OF THE INVENTION

If we examine the loss of pressure experienced by the working fluid as it passes through decreasing pressure stages, it will be observed that the primary portion of the pressure difference between two consecutive modular stages corresponds essentially to the loss in pressure caused by flashing of the liquid phase as it enters the heat exchanger. This flashing brings about an irreversible energy loss.

In the development of the present invention, the thermal exchanges in the heat exchanger have been particularly stressed along with reduction in pressure loss.

Generally speaking, in order to achieve efficient heat exchange in tubes, it is necessary to incur a pressure loss as fluid flows through those tubes. Again, generally speaking, the greater the pressure loss, the greater the heat exchange. This correlation (the classical Reynolds analogy), takes a particular character in cases where the liquid vapor phase change occurs in the tube. The associated physical phenomenon produced during a vapor liquid phase change in a fluid flowing through a tube gives, depending upon the magnitude of flow parameters such as mass flow rate, thermal input, etc., a great variety of different fluid flow regimes (stratified, unsteady, annular) as well as a different thermokinetics (evaporation, nucleate boiling, etc.).

Among these various flow regimes, there are some whih present special interest since they allow a very high thermal flux or heat transfer rate: i.e., greater than 50 kilowatts per square meter with a temperature difference between the fluid and the wall as low as 1° C. These regimes are obtained when the ratio between the mass of vapor and the total mass of vapor plus liquid is within the range of about 0.03 and 0.97. (This ratio of the mass of vapor to the combined mass of vapor plus liquid is referred to hereinafter as the "quality" of the vapor.)

These conditions prevail when a fluid is completely two-phase with a substantial loss in pressure, i.e., on the order of 0.3 bars per meter for tubes of 20 milimeter diameter (see Fifth International Heat Transfer Conference, 1974, Tokyo, Handbook of Heat Transfer, Rosenow).

Such operating conditions are compatible with the processes of the previously mentioned patents. Actually, a temperature difference of 5° C. between two successive modules creates a pressure difference, for ammonia, that could be on the order of 3 bars. Such pressure loss corresponds to a tube of 10 meters length carrying a pressure drop of 0.3 bar per meter.

The value of the vapor quality or mass ratio which permits the above-discussed flow regime to occur can easily be obtained in the heat exchanger that receives liquid from a modular stage which is in equilibrium with its vapor stage. Under these circumstances, it is sufficient to supply a small quantity of heat to the liquid phase to cause it to boil, meaning that the quality becomes greater than zero and surpasses the minimum value. It is only required to calculate the loss in thermal flux so that at the time of exit from the heat exchanger the liquid phase is not been completely transformed to the vapor phase. That is, the vapor quality is less than 0.97, so that it supplies a mixture of liquid and vapor. Similarly, for a module in which the condensable fluid gives up heat, it is sufficient to predict, before entry into the heat exchanger the quantity of vapor which must be added to the liquid so that the vapor will only be totally condensed adjacent the exit of the heat exchanger.

Accordingly, all or nearly all of the heat exchanger surface will work under favorable thermal flow conditions from the side of the condensable fluid.

Generally, it is not possible to obtain such ideal conditions on the other side of the heat exchanger wall since the second fluid which is heated or cooled is not generally under condensible saturated conditions of pressure and temperature. Generally, the difficulty is substantially diminished when geothermal water, or water from industrial coolants or heaters is used instead of costly, dangerous, corrosive or scarce fluids.

There are many reasons why the heat exchangers functioning according to the above principles had not been widely used. The study of two-phase systems during the phase change is extremely complex and the necessary information for the calculations are not always available. In addition, the interest in a large heat exchange coefficient is not as great in a heater, for example, where the temperature difference between the walls of the heat exchanger is on the order of several hundred degrees centrigrade. On the other hand, in a heat pump where the temperature difference across the heat exchanger wall is only a few degrees centigrade and where the loss of pressure is associated with a loss in thermal energy, there is a great interest in very high heat transfer coefficients. In the case of the apparatus according to the present invention, the pressure difference across the heat exchanger is not asociated with any significant energy losses.

The present invention has an object of exchanging heat with fluid passing from one enclosure where that fluid is in its saturated conditions of pressure and temperature, to a second enclosure where that fluid is also in saturated conditions but at a lower pressure and temperature. During this fluid passage, heat is furnished to or removed from the working fluid as it passes through the tubes of a heat exchanger containing another heat carrying fluid. The process allows at least one part of the fluid passing through the heat exchanger to be in its two-phase condition with a quality of about 0.03 to about 0.97. During a large portion of the fluid movement through the heat exchanger, it undergoes a pressure loss corresponding to the greater part of the pressure difference between the first and second enclosures.

While the heat exchanger discussed above refers to a heat exchanger having tubes, it is clear that this invention is also applicable to a heat exchanger with a single tube or other general configuration.

During passage through the heat exchanger, a working fluid can be (a) a two-phase fluid with a quality in the range of 0.03 to 0.97; (b) essentially in the vapor state with a quality greater than 0.97; or (c) essentially in the liquid state with a quality less than 0.03. In the case where the fluid is essentially at the saturated vapor state, the pressure loss is great; however, the pressure loss is lower than the pressure loss observed when the fluid has two-phases and the heat transfer coefficient is very low. This situation (essentially vapor) is therefore to be avoided or limited at the maximum.

In the case of a fluid which is essentially in the saturated liquid state, the pressure loss is weak but the coefficient of heat transfer is also very weak. This situation is less unfavorable than when the fluid is essentially gaseous. However, this case calls for very long, almost useless, tubes causing excessive investment expenses and substantially increased cumbersomeness.

Given the importance of a pressure loss in the heat exchanger and the two-phase flow regime, it is clear that except in special systems the greatest pressure loss occurs between the two enclosures unless there are special unforseen conditions such as choking in the piping upstream or downstream of the heat exchanger.

Such flow phenomena are to be avoided due to the loss of energy associated therewith and also for the reason that pressure differences in the heat exchanger are limited. Nevertheless, for an adjustment at the end of the process, it is possible to foresee a small and adjustable loss of pressure upstream or downstream.

The two-phase flow regime exists without any doubt in certain points of heat exchangers, but they have not yet been systematically exploited in staged heat pumps where the working fluid passes from one module to another with its own pressure acting as a driving force. In addition, the two-phase flow regime has not been used in heat pumps where the liquid is in equilibrium with its vapor phase in each stage.

In such a system, we must have a sensible correlation among the different parameters in order to know the thermal flow received or given up by the working fluid, the geometry of the heat exchanger, the pressure change in the heat exchanger. Therefore, it is clear that we are not entirely the master of these parameters. The first parameter represents external restrictions while the last parameters affect the function of the whole installation in such a way that all modifications affect, as in a chain reaction, all the other stages. Accordingly, it is difficult to remedy these disturbances and to proceed to start.

It appears that the most efficient way of adjusting the operation of the apparatus is to act on the pressure loss associated with traversing the heat exchanger tubes. This implies that, contrary to the prior art, all the flow between the stages does not constantly occur over tubes of the same heat exchanger or the same tubes of the heat exchanger. In other words, one part of the flow transferred to one enclosure to another does not pass through the heat exchanger and is directed either into a second heat exchanger or into a conduit where it experiences a pressure loss corresponding with the pressure difference between the two enclosures.

Accordingly, the invention furnishes a heat exchanging method in which heat supplied or removed by a heat carrying fluid is used to change a working fluid from its liquid state to its vapor state or vice versa. According to the process two fluids are circulated in a series of modular stages each having an enclosure where the liquid and vapor phases of the working fluid are in equilibrium. Each of the enclosures is at a pressure and temperature corresponding to saturated conditions. The vapor phase is extracted from each enclosure and forwarded to a compressor; whereas the liquid phase of the working fluid passes from one module to another in the direction of decreasing pressures. At least one portion of the liquid phase passes through the heat exchanger whereas a second portion of the liquid phase bypasses the heat exchanger and is taken directly to a second enclosure. In order to control the operating conditions in the heat exchanger, the proportioning between the two fluid phase portions may be regulated. Such a method is applicable to the apparatus of French Pat. No. 7614965 in which the vapor exhausting from a compressor stage is sent directly to an adjoining module at a higher pressure and temperature so as to be placed in contact with the liquid phase.

In accordance with an advantageous embodiment of the invention, when it is desired to saturate in a modular stage, the vapor flow originating from the adjacent stage at a lower pressure and temperature and having crossed the exchanger of the first modular stage can be effected by placing the vapor phases in intimate contact as in the process described in the above patent or by other means. To operate the cooling, we send into this vapor bleed at least one part of the liquid phase that has not gone through the heat exchanger.

Following another advantageous embodiment, which may be combined with the preceding embodiment, at least one part of the liquid phase that has not been through the heat exchanger is passed through an ejector where that liquid phase absorbs at least a part of the vapor phase coming in from the adjacent module at lower pressure and temperature which has also crossed the compressor. In this manner, the vapor phase is compressed and cooled. Therefore, the energy used to retard flow of the liquid phase between the two modules is not lost but is employed to reduce the work required from the vapor compressor.

BRIEF DESCRIPTION OF THE DRAWINGS

An apparatus for carrying out the above-described process will now be described in reference to the drawings wherein like reference numerals have been applied to like elements wherein.

DESCRIPTION OF THE PREFERRED EMBODIMENTS

Figure 1:
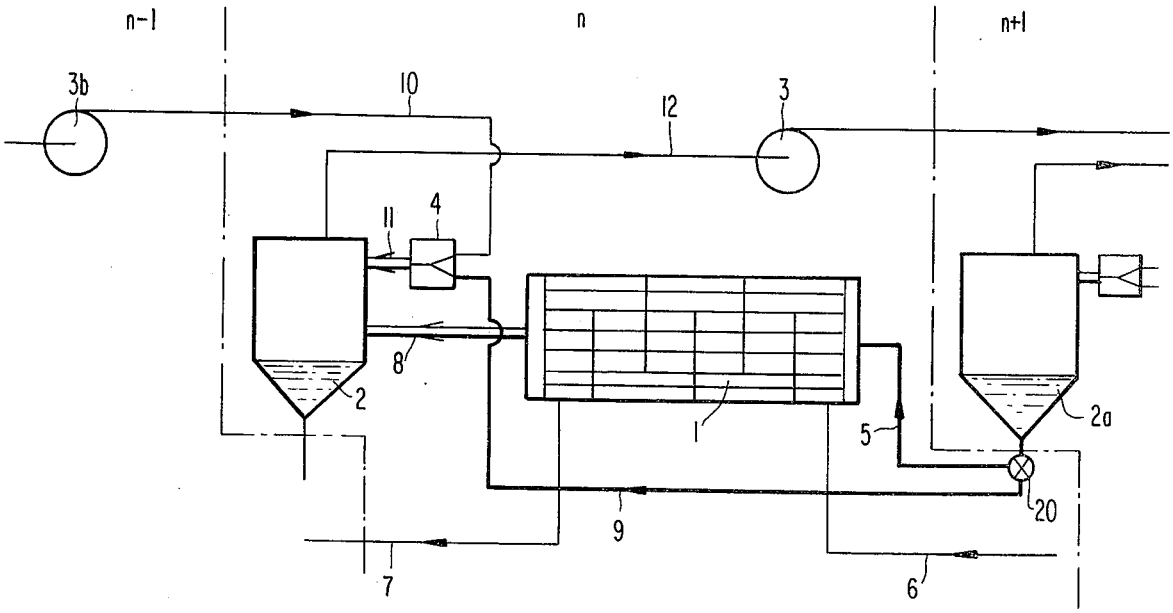
FIG. 1 is a schematic illustration of a heated modular stage.

The example to which the drawings refer is described as a non-restrictive embodiment and is a heat pump functioning with ammonia as the working fluid and warm water of geothermal origin as the fluid heat source or fluid heat sink. The fluid heat sink may also be water used for heaters or dryers in industrial applications.

The heat pump contains a predetermined number of modular stages that are traversed by the ammonia as the working fluid.

Each modular stage includes a plurality of elements including a heat exchanger 1, a liquid-gas separator 2, a compressor stage 3 and an ejector 4. The heat exchanger has a plurality of tubes through which ammonia is circulated and around which the heat exchanging fluid circulates. The liquid-gas separator may, for example, be of the cyclone type which is operable to mix the liquid phase with the vapor phase so as to obtain a predetermined thermodynamic equilibrium. The compressor 3 operates solely on the vapor phase and communicates with the separator. The ejector 4 is traversed by the high pressure liquid phase and transforms the potential energy of the liquid phase partially into kinetic energy so as to absorb, pressurize and cool the vapor phase admitted to the ejector from the compressor of an adjacent modular.

Some modular stages do not include all of the above-identified features. For example, the end module or terminal module with high pressure and temperature does not have a heat exchanger, a compressor stage or an ejector. The end or terminal module with a low pressure does not require a separator. In fact, for this module the separator may be replaced by a simple container.

Figure 2:
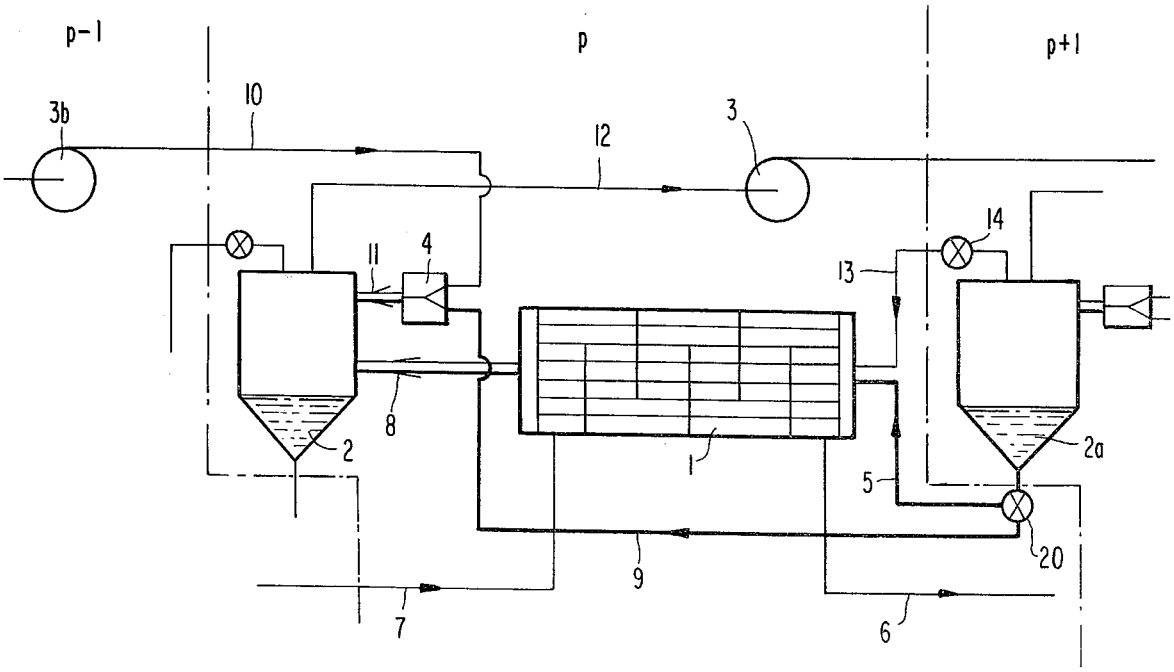
FIG. 2 is a schematic illustration of a cooled modular stage.

The apparatus according to the present invention has two general types of modular stages, one type called "heated" (see FIG. 1) and a second type called "cooled" (see FIG. 2).

In the drawings the stages having comparatively high pressure and temperature are situated on the right whereas stages having comparatively lower pressure and temperature are positioned on the left. In FIG. 1, the heated modular is indicated by an N, and the neighboring stages are designated by $N-1$ and $N+1$ in the order of increasing pressure. Similarly, in FIG. 2 the cooled modular stage is designated by the letter P and adjacent modular stages $P-1$ and $P+1$ are also arranged in the order of ascending pressure.

In a heated modular stage N (see FIG. 1) the ammonia compartment of the heat exchanger 1 is fed from the adjacent modular stage $N+1$ operating at higher pressure and temperature conditions. Fluid communication between the two stages N, $N+1$ is effected by a pipe 5 which feeds the essentially liquid phase from the bottom portion of the separator 2*a* of stage $N+1$. The second side of the heat exchanger 2 is supplied with water by means of a conduit 6. The conduit 6 may communicate either with a source of water or with the heat exchanger of a stage having a higher pressure and temperature, for example $N+1$. Water is directed away from the second side of the heat exchanger by a pipe 7 which may carry the water to the heat exchanger to the next adjacent stage N−1 operating at lower pressure and temperature.

In the heat exchanger 1, the ammonia receives a heat from the water which is, therefore, cooled. The heat removed from the water causes at least partial evaporation to commence in the ammonia so that the ammonia becomes a two-phase fluid. It is of course possible, that the ammonia is converted entirely into the vapor phase. The two-phase fluid is then sent to the separator 2 by means of a connecting conduit 8. This conduit 8 may be eliminated, in which case, the tubes of the heat exchanger 1 will empty directly into the separator 2. As discussed above, it is not desirable to have total evaporation occur in the heat exchanger at a distance far from its exit. On the other hand, it is acceptable to have the ammonia working fluid exhaust from the heat exchanger in two phases.

A fraction of the fluid exhausting from the separator 2*a* of the adjacent modular stage N+1 communicates by means of a bypass conduit 9 with an ejector 4. This fraction of the working fluid in the lquid phase does not pass through the heat exchanger. The liquid phase passing through the bypass conduit 9 is accelerated to great speed as it passes through an ejection nozzle in the ejector 4. The accelerated fluid is placed in contact with the vapor phase supplied from a compressor 3*b* of the adjacent modular stage N−1. This vapor phase in communicated to the ejector by means of the conduit 10. Acceleration of the liquid phase is accomplished by partial evaporation such that a two-phase fluid is exhausted at high velocity from the ejector. The vapor phase is supplied both by the conduit 10 and by evaporation of the liquid phase supplied by the conduit 9 as a result of reduced static pressure associated with the acceleration. The resulting two-phase mixture is carried by the pipe 11 to the cyclone separator 2 where it joins and mixes with the two-phase flow entering from the pipe 8.

The vapor phase is extracted from the upper part of the separator 2 and communicates through a pipe 12 with the inlet to a compressor 3. Simultaneously, as discussed above, the liquid phase is forwarded to a modular stage N−1 from the lower portion of the separator 2 by means of a conduit. A suitable valve 20, may be used to control or otherwise proportion the distribution of liquid phase flow coming from the separator 2*a* of stage N+1. The valve 20 splits the liquid phase flow between the pipe 5 and the bypass conduit 9 in such a manner that the final zone of vaporization occurs near the exit of the heat exchanger 2.

A cooled modular stage P, as shown in FIG. 2, is distinguished from the heated modular stage by the following factors.

The heat removing fluid (i.e., the heated fluid) in a cooled stage passes through the heat exchanger in a direction which is opposite to the directional flow of the heat supplying fluid in the heated modular stage. More specifically, with reference to FIG. 2 the heat removing fluid enters by way of conduit 7 and exhausts by way of conduit 6 toward the module P+1.

Secondly, the heat exchanger 1 must be fed with a two-phase fluid from the separator 2*a* of the adjacent stage P+1 operating at higher pressure and temperature conditions. For this reason, a supplementary vapor bypass conduit 13 communicates between the upper part of the separator 2*a* and inlet to the heat exchanger 1 at the pipe 5. This bypass conduit 13 is equiped with a suitable control valve 14. Actually, the quantity of condensed vapor in the heat exchanger 1 is in proportion to the thermal flux removed by the cooling water.

The other parts of the cooled modular stage are the same as for the heated modular in FIG. 1. However, it is important to note that the conduit 8 connecting the heat exchanger 1 with the separator 2 should normally carry only a liquid phase flow.

In modules of one type or the other, the valves 20 which control distribution of the fluid flow between the pipes 5 and bypass conduit 9 are conrolled by a parameter associated with the operating conditions inside the heat exchanger. A simple method of regulating the quantity of liquid phase present in the exchanger applies.

On the other hand, it not necessary that the entire vapor phase coming from the compressor stage 3*a* be placed in contact with the liquid phase. For example, all or a portion of the vapor phase can pass directly by a compressor stage 3 without going through the ejector or through the separator to attain saturated thermodynamic conditions, i.e., cooled. This cooling can be operated in a rotating machine by itself.

Figure 3:
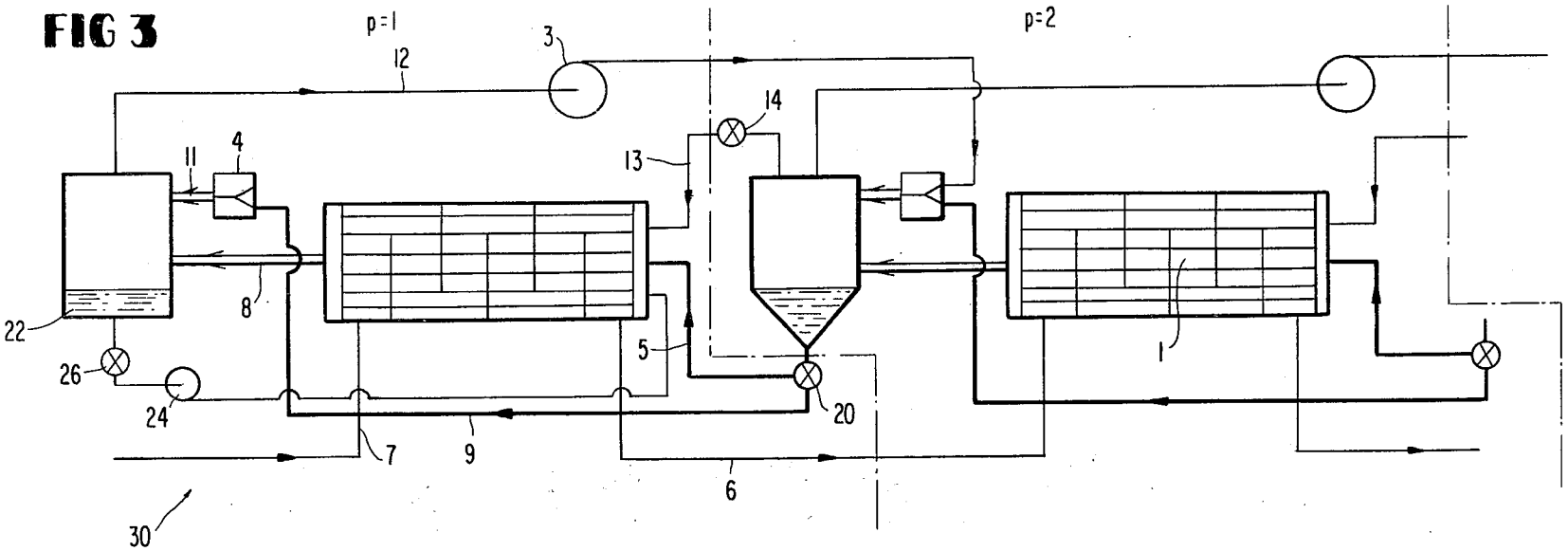
FIG. 3 is a schematic illustration of low end modular stages operating at lowest pressure and temperature in the system.

The terminal or end modules present particular problems. At the one end (see FIG. 3), i.e., the modular stage 30 having the lowest pressure and temperature conditions, the separator is replaced by simple reservoir 22 (see FIG. 3) for which the working fluid can exhaust only the vapor form. Removal of the liquid phase from this modular stage will threaten to promote blockage since the liquid phase has not been conditioned by passing through a heat exchanger. In such a situation, it is preferable to foresee that a variable quantity (controlled by a valve 26) of liquid phase is taken out of the reservoir and reinjected upstream of the nearest heat exchanger. This type of liquid phase circulation would require the assistace of a pump 24 in order to overcome the pressure differential between adjacent modules.

Figure 4:
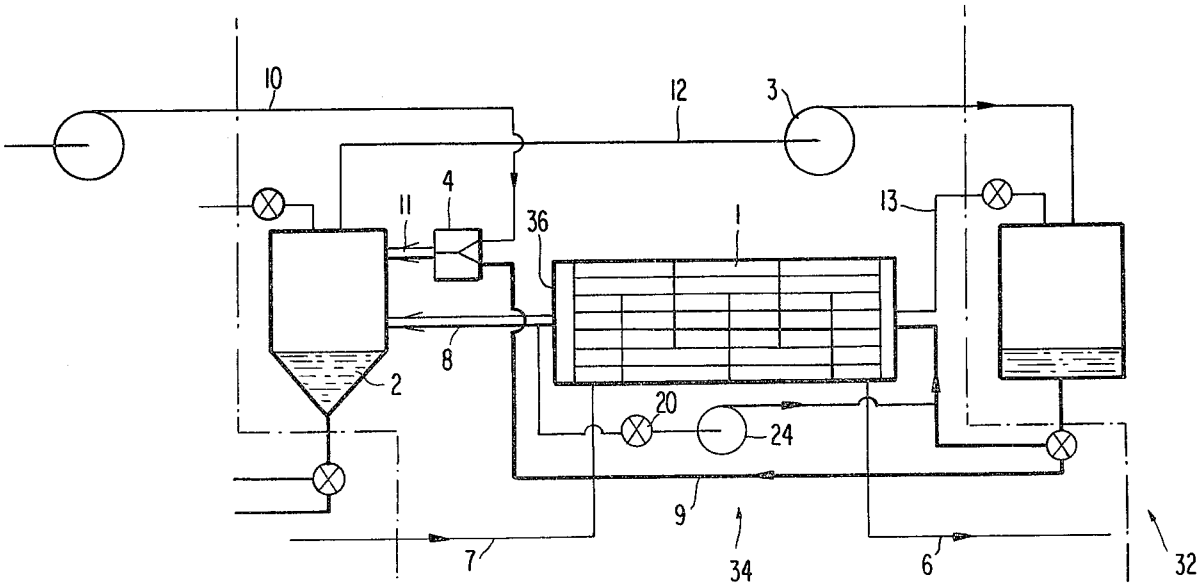
FIG. 4 is a schematic illustration of high end modular stages operating at highest pressure and temperature in the system.

In the modular stage 32 (see FIG. 4) having the highest pressure and temperature conditions, superheating of the vapor phase from the last compressor stage 3 can only be counteracted with the assistance of a liquid phase coming from a module having higher pressure and temperature. Therefore, the last heat exchanger 1 in the system risks loss of its optimum operating conditions. In order to avoid this problem, it is appropriate to realize in advance that the liquid phase taken out at downstream end 36 of the heat exchanger 1 in the adjacent module 34 is reinjected upstream of this last mentioned heat exchanger in a variable quantity (via valve 26) with the assistance of a pump (28) to overcome the pressure differential. Accordingly, the present invention does not interfere with the existing adiabatic modular stages in the plurality of stages defining the system. That is to say those modular stages without heat exchangers.

It will now be apparent that an improved heat exchange process and apparatus have been disclosed. Moreover it will apparent to those skilled in the art that numerous modifications, variations, substitutions and equivalents exist for features of the invention which do not materially depart from the scope of the invention. Accordingly, it is expressly intended that all such modifications, variations, substitutions and equivalents which fall within the spirit and scope of this invention as defined in the appended claims be embraced thereby.

What is claimed is:

1. A process for exchanging heat with a fluid comprising the steps of:

passing a first fluid through at least two enclosures, the pressure and temperature of the fluid in each enclosure being in the saturated liquid-vapor thermodynamic region, the pressure and temperature in the first enclosure being greater than the pressure and temperature in the second enclosure;

passing the first fluid through a heat exchanger under conditions of pressure and temperature such that the quality of the liquid-vapor mixture lies in the range of 0.03 to 0.97 and such that the first fluid experiences a pressure drop in the heat exchanger which corresponds to the greater part of the pressure difference between the first and second enclosures; and exchanging heat between the first fluid and a second fluid in the heat exchanger.

2. A heat exchange process comprising the steps of:

providing a plurality of modular stages, each having an enclosure, heat exchanger and a compressor;

circulating a first fluid and a second fluid through the plurality of modular stages;

maintaining the enclosure of each stage at pressure and temperature conditions in the saturated liquid-vapor thermodynamic region so that liquid and vapor phases of the first fluid coexist in the enclosure with thermodynamic equilibrium while maintaining the pressure and temperature conditions of adjacent stages at different levels such that movement from stage to stage in one direction correlates with increasing pressure and temperature conditions;

compressing vapor from the one enclosure with the compressor of the corresponding modular stage and delivering the pressurized vapor to an adjacent stage operating at a higher pressure;

dividing the liquid phase from the one enclosure into a first portion for the heat exchanger and a second portion for a bypass conduit communicating with an adjacent stage operating at a lower pressure;

passing the first portion through the heat exchanger under conditions of pressure and temperature such that the quality of liquid-vapor mixture lies in the range of 0.03 to 0.97 and such that the first portion experiences a pressure drop in the heat exchanger which corresponds to more than half of the pressure difference between the modular stage and the adjacent stage operating at a lower pressure;

exchanging heat between the first portion and a second fluid passing through the heat exchanger; and controlling the desired pressure and temperature conditions in the heat exchanger by proportioning the liquid phase between the heat exchanger and the bypass conduit.

3. The process of claim 2 further including the step of:

cooling the pressurized vapor entering the modular stage from the adjacent stage operating at lower pressure and temperature by mixing it with the second portion of the liquid phase which bypasses the heat exchanger.

4. The process of either claim 2 or claim 3 further including the step of:

delivering the pressurized vapor entering the modular stage from the adjacent stage operating at lower pressure and temperature along with the second portion of the liquid phase bypassing the heat exchanger to an ejector so as to absorb, compress and cool the pressurized vapor.

5. Modular apparatus for exchanging heat with a fluid comprising:

a plurality of modular stages, each having enclosure means for containing liquid and vapor phases of a working fluid in thermodynamic equilibrium, a heat exchanger communicating with the enclosure means, a vapor compressor with an inlet and an outlet, the inlet communicating with the enclosure means, liquid bypass conduit communicating with the enclosure means and bypassing the heat exchanger, means for proportioning a liquid phase between the heat exchanger and the liquid bypass conduit, and means for passing a second fluid through the heat exchanger in heat exchange relationship to the liquid phase;

the proportioning means of one stage being in fluid communication with the enclosure means of an adjacent stage, and the vapor compressor outlet being in fluid communication with the enclosure means of the adjacent stage.

6. The apparatus of claim 5 wherein each stage further includes ejector means for cooling compressed vapor, the ejector means having fluid communication with the enclosure means, the liquid bypass conduit and the vapor compressor outlet of a second adjacent stage.

7. The apparatus of claim 5 wherein each stage further includes:

vapor bypass conduit communicating with the enclosure means;

valve means for regulating vapor flow through the vapor bypass conduit; and the heat exchanger communicates with the vapor bypass conduit of the adjacent stage.

8. The apparatus of claim 5, 6, or 7 including means for extracting the liquid phase from a first enclosure and injecting that liquid phase upstream of the most closely adjacent heat exchanger.

9. The apparatus of claim 5, 6, or 7 including means for extracting the liquid phase downstream of the heat exchanger and reintroducing it upstream of that heat exchanger.

10. Apparatus according to claim 5, 6, or 7 including means for injecting the liquid phase directly into the compressor.

* * * * *